US008327764B2

(12) United States Patent
Trousselle et al.

(10) Patent No.: US 8,327,764 B2
(45) Date of Patent: Dec. 11, 2012

(54) PYROELECTRONIC DETONATOR PROVIDED WITH A CIRCUIT FOR SHUNTING AN ELECTROTHERMAL BRIDGE

(75) Inventors: Raphael Trousselle, Auxerre (FR); Franck Guyon, Auxerre (FR); Arthur Poudre, Auxerre (FR)

(73) Assignee: Davey Bickford, Hery (FR)

( * ) Notice: Subject to any disclaimer, the term of this patent is extended or adjusted under 35 U.S.C. 154(b) by 585 days.

(21) Appl. No.: 11/722,542

(22) PCT Filed: Dec. 23, 2005

(86) PCT No.: PCT/FR2005/051145

§ 371 (c)(1),
(2), (4) Date: Aug. 21, 2007

(87) PCT Pub. No.: WO2006/070170

PCT Pub. Date: Jul. 6, 2006

(65) Prior Publication Data

US 2010/0000435 A1 Jan. 7, 2010

(30) Foreign Application Priority Data

Dec. 23, 2004 (FR) ..... 04 53204

(51) Int. Cl.
*F42B 3/182* (2006.01)

(52) U.S. Cl. ..... 102/202.3

(58) Field of Classification Search ..... 102/202.2, 102/202.3, 202.4

See application file for complete search history.

(56) References Cited

U.S. PATENT DOCUMENTS

| | | | | | |
|---|---|---|---|---|---|
| 2,918,001 | A | * | 12/1959 | Alford | 102/202.2 |
| 3,343,491 | A | * | 9/1967 | Peters, Jr. | 102/206 |
| 3,640,224 | A | * | 2/1972 | Petrick et al. | 102/202.2 |
| 3,683,811 | A | | 8/1972 | Driscoll | |
| 4,050,382 | A | * | 9/1977 | Power | 102/207 |
| 4,103,619 | A | | 8/1978 | Fletcher et al. | |
| 4,145,970 | A | * | 3/1979 | Hedberg et al. | 102/218 |
| 4,304,184 | A | * | 12/1981 | Jones | 102/202.13 |
| 4,967,665 | A | * | 11/1990 | Baginski | 102/202.2 |
| 5,099,762 | A | * | 3/1992 | Drapala | 102/202.1 |
| 5,279,225 | A | * | 1/1994 | Dow et al. | 102/202.2 |
| H0001476 | H | * | 9/1995 | Braun | 102/220 |
| 5,460,093 | A | * | 10/1995 | Prinz et al. | 102/217 |
| 6,173,651 | B1 | * | 1/2001 | Pathe et al. | 102/218 |
| 6,220,163 | B1 | | 4/2001 | Duguet et al. | |
| 6,739,264 | B1 | * | 5/2004 | Hosey et al. | 102/202.9 |

FOREIGN PATENT DOCUMENTS

| | | |
|---|---|---|
| GB | 313605 | 11/1930 |
| WO | 2004/010554 | 1/2004 |

* cited by examiner

*Primary Examiner* — Bret Hayes
*Assistant Examiner* — Reginald Tillman, Jr.
(74) *Attorney, Agent, or Firm* — Young & Thompson

(57) ABSTRACT

A pyroelectronic detonator (1) includes an electronic circuit for at least controlling the detonator ignition by supplying igniting current to an electrothermal bridge (4) and at least one electronic shunting element (7) directly connected to the bridge (4), wherein the shunting element (7) is controllable between the closed low-electric resistance state of the shunt and the open high electric resistance state thereof and the electronic circuit (2) controls the states. The shunt is constructed in such a way that it can be monostable and bistable.

16 Claims, 1 Drawing Sheet

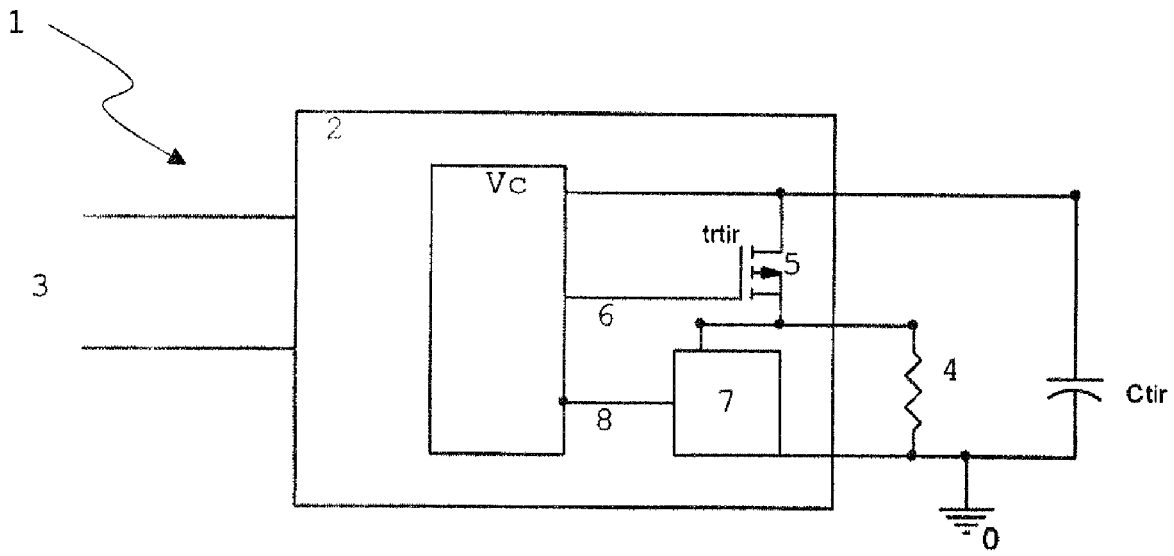
1
2
Vc
trtir
5
3
6
4
7
8
Ctir
0

PYROELECTRONIC DETONATOR PROVIDED WITH A CIRCUIT FOR SHUNTING AN ELECTROTHERMAL BRIDGE

The present invention relates to a pyroelectronic header with electrothermal bridge shunting circuit. It finds application in the field of pyrotechnics for at least controlling the firing of headers.

Electrical firing of the headers is an old technique known. It consists in sending in an electrothermal bridge in contact with a primary composition, via an electrical line, a current sufficient to cause the firing of the primary composition. It has evolved recently thanks to the implementation of electronic headers which may receive orders over the electric line, for instance initiation and/or programming specific selection orders (retardation, firing . . . ), and/or which may send data over the same electric line, for instance header identification data.

Safety is a fundamental element of this field of pyrotechnics and solutions have been developed for reducing the risks of unduly firing of the header, for instance because of transient currents or of electrostatic discharges. Indeed, if in the case of purely electric headers comprising only one electrothermal bridge connected directly to an firing line, bridges may be implemented which require larger energies to cause the firing of the header so as to reduce the sensitivity of the assembly, the case of headers including electronic circuits is more complex due to their intrinsic sensitivity to the weak currents and/or to the electrostatic discharges. It has therefore been suggested to implement in relation with the electronic circuits, passive protection devices such as chopper circuits or limiters (dischargers, input diode array, input low-pass RC filter . . . ). These solutions are not only passive, they are implemented on the firing line interface side (more generally enabling encoded command and/or data exchanges and/or supply for electronic headers).

This invention offers for its own part, the use of an active solution which is implemented in relation with the electrothermal bridge and which involves placing parallel to the bridge an electrical shunt, preferably two-directional, controllable, monostable or bistable. For the bistable shunt, the commands enable to put the shunt either into a stable closed state (preventing the bridge from operating and hence the firing, the shunt then exhibits low electrical resistance in particular relative to the resistance of the bridge), either into a stable open state (the shunt then exhibits high electrical resistance in particular relative to the resistance of the bridge and derives hence a negligible current). For the monostable shunt, the commands enable to put the shunt either into a state wherein it may switch over from the open state towards the closed state, said state being a so-called switchover state, wherein the switchover depends on a switchover threshold of bridge electrical signal, the switchover towards the closed state being obtained when the electrical signal applied to the bridge exceeds the threshold, or into a forced open state. If preferably, the monostable shunt having switched into the closed state switches again towards the open state when the electrical signal comes back under a threshold, the case when the monostable shunt remains into the closed state after the switchover is also contemplated, it should be understood that then a specific command should be implemented so as to switch it over again toward the open switchover state (whence it may toggle towards the closed state if the threshold is still once exceeded upwards) or sending an open state forcing command.

It should be understood that into the closed state, the shunt which is parallel to the bridge short-circuits substantially the bridge which then may not operate any longer and cause the firing (may not be heated sufficiently any longer failing any sufficient current circulating therein). The monostable shunt is sized so that its switchover threshold is smaller than the couple Rheader × Io header, Rheader being the resistance of the header and Io header the maximum non-firing intensity of the header, wherein the shunt is conducting above this threshold and non-conducting below this threshold, which renders any unduly initiation impossible. The monostable shunt behaves like a controllable chopper circuit whereof the closed state implies that the bridge will only see a voltage ranging, according to the type of shunt, between zero volt (perfect short-circuit) and at most Rheader × Io header volts (true limiter). Preferably for the bistable shunt, the shunt into the closed state is set up so that the bridge only sees a voltage ranging, according to the type of shunt, between zero volt (perfect short-circuit) and at most Rheader × Io header volts (true limiter).

The invention relates hence to a pyroelectronic header comprising an electronic circuit at least for controlling the firing of the header by sending a firing current into an electrothermal bridge.

According to the invention, the header includes moreover at least one electrical shunting means arranged in direct relationship with the bridge, wherein the shunting means is controllable via commands enabling state selection, the states being a low electric resistance closed state of the shunt intended for preventing the firing of the header while bypassing through the shunt the current of the bridge and a high electric resistance open state of the shunt (and hence authorising a firing which will be obtained when a current is sent into the bridge further to a firing command coupled or not with a state command).

In various embodiments of the invention, the following means which may be used individually or in all the technically possible combinations, are used:

- the shunt is bistable, wherein the commands enable to put the shunt either into a stable closed state, either into a stable open state,
- the shunt is monostable, wherein the commands enable to put the shunt either into a switchover state at least from the open state towards the closed state, wherein the switchover depends on a switchover threshold of bridge electrical signal, the switchover towards the closed state being obtained when the electrical signal applied to the bridge exceeds the threshold, either into a forced open state,
- after switching over towards the closed state of the monostable shunt, said shunt switches again towards the open state when the electrical signal comes back under a threshold,
- the monostable shunt which switches again towards the open state when the electrical signal comes back under the threshold, exhibits a hysteresis, wherein the switchover threshold from the open state to the closed state is greater than the switchover threshold from the closed state to the open state,
- the monostable shunt which switches again towards the open state when the electrical signal comes back under the threshold is time-delayed, the switchover back towards the open state occurring after a preset delay once the signal has come back below the threshold,
- the monostable shunt which switches again towards the open state when the electrical signal comes back under the threshold is time-delayed, the switchover back towards the open state occurring after a preset delay once the signal has come back and remains below the threshold, (the signal must remain below the threshold for a certain time for the switchover to take place), after switching over towards the closed state of the monostable shunt, said shunt remains into the closed state regardless of the level of the electrical signal, a specific command enabling to switch it over again into the open state (switchover state or forced open state), the same shunt can be monostable or bistable according to the type of command received, the threshold is a voltage threshold selected as being smaller than the product Rheader × Io header, Rheader being the resistance of the header and Io header the maximum non-firing intensity of the header, the resistance in closed state of the shunt is smaller than the resistance of the bridge divided by 10, the bridge electrical signal is the voltage at the terminals of the bridge, the bridge electrical signal is the voltage at the terminals of an capacitor intended for being discharged through the bridge during firing, the shunt is two-directional, (on top of a current of constant polarity—direct current of any shape—the two-directional shunt lets through a possible alternating current) (the electrical characteristics of conduction into the closed state may be different according to the direction—polarity—of the shunted current as for example In the case of a shunt formed of an NPN transistor and of a diode in parallel, cathode on the collector and anode on the emitter: in one direction conduction threshold of the diode, in the other saturation voltage of the transistor made conducting)

the header includes an ASIC-configurable electronic circuit, the shunt being inside or outside said circuit, (ASIC="application specific integrated circuit":), the shunt is a component selected among at least one (that is to say one or several or an association of these components, for instance a transistor and a thyristor or triac) or several of the following components:

an electromagnetic relay, a static relay, a bipolar transistor, a field effect transistor, a thyristor, a triac, a micromechanical electrical switch (MEMS), a diode, a Zener diode, a neon, at rest, the shunt is in a state corresponding to an impossible firing, (relates as well to a header not connected to a firing line, not power supplied, as a header connected to a firing line carrying a communication and/or power supply current for a code-controlled header, outside a desinhibition or activation code these terms being equivalent)

the header includes moreover means for measuring the current carried through the shunt and the change or switchover toward the open state is possible only if the current measurement is smaller than a predetermined current threshold, the states of the shunt are controlled by commands (codes) sent over a firing line connected to the electronic circuit of the header, the control voltage of the opening of the shunt is greater than the minimum operating voltage of the logic of the electronic module, the header includes means enabling the switchover to a state corresponding to a possible firing to be controlled by a desinhibition command sent into the header, the header includes means enabling the switchover to a state corresponding to an impossible firing to be controlled by an inhibition command sent into the header.

Thanks to the implementation of a shunt, on top of increased safety, it is possible to conduct tests on the header up to an electrical discharge (simulation of a transient current or firing command but with firing inhibition by stable closed shunt or in a switchover state) in the final circuit of the bridge but without causing real firing of the header since the discharge is essentially derived through the shunt. More thorough tests than what was possible previously may then be conducted.

This invention will now be exemplified without being limited thereto with the following description in relation with the following FIGURE:

FIG. 1 which represents a functional diagram of a header according to the invention.

On FIG. 1, the header 1 includes an electronic module 2 connected at 3 to a firing line and through which, according to the degree of complexity of the module 2, a firing current or orders (codes or various instructions among which the firing) are received by the module and, optionally, data which may be sent from the module to the outside. The module includes an electronic control circuit. A thermoelectrical bridge 4 is connected to two electric power supply lines via a firing control element, trtir, which is a transistor 5, preferably MOS as on FIG. 1. A storage capacitor Ctir is arranged between both power supply lines and is intended for storing energy in particular designed for firing. A shunt 7 is arranged parallel to the bridge 4. The open or closed states of the shunt may be controlled by the electronic circuit by the line 8. The electronic circuit, via a line 6, may control the firing of the header by making the transistor 5 conducting (and providing that the shunt 7 is in a stable or forced open state).

In the case of a bistable shunt, the commands enable to switch the shunt from a stable open state to a stable closed state and conversely.

In the case of a monostable shunt, the commands enable to switch the shunt from a switchover state wherein the shunt may switch at least from an open state to a closed state, according to the value of a bridge electrical signal measured at the terminals of the bridge or at the terminals of the capacitor Ctir, relative to a threshold, or to switch it towards a forced open state and conversely. In the switchover state the shunt may switch over back to the open state automatically or not to suit the electrical signal according to the variation implemented.

Preferably, it is the electronic circuit which controls the switchover according to the bridge electrical signal, wherein the shunt is in the form of a simple toggle switch or switch. Preferably, an electronic shunt is implemented which is or includes a bipolar or field effect transistor, in particular MOS for the latter. In a variation where the electronic circuit does not carry out such controls, the shunt includes own means for measuring the signal and for controlling the switchover.

It is also possible to implement additional safety means with a current measurement running through the shunt 7 which is parallel to the thermoelectrical bridge 4 and the state switchover from the closed state (hence inhibited header) towards the open state (desinhibited header, then authorising a possible firing) will only be authorised if the current measurement is smaller than a threshold.

In a variation of the invention, It is also possible to implement moreover the shunt which is parallel to the bridge, an additional switching circuit (open=non-conducting/closed=conducting) controllable in series with the bridge, the shunt being parallel to the switching circuit and to the bridge, two latter being in series, the switching circuit having reversed commands relative to the shunt (for the firing the switching circuit should be closed and the shunt open). Alternately to this variation, the switching circuit can be in series with the bridge and the shunt which are in parallel. In both cases, the switching circuit is preferably distinct from the firing control element 5. It should be noted that this variation exhibits the shortcoming of adding a switching circuit which may exhibit a certain internal resistance same when closed, here in series with the bridge, which may reduce the energy supplied to the bridge.

Finally and preferably, when the header is at rest, not used, not connected to a firing line, not power supplied, possibly even connected and power supplied by a firing line, the header is initially (in the absence of contrary command) in a state of inhibition of the firing, that is to say that the shunt is in a stable closed state (case of the bistable shunt) or a switchover state (case of a monostable shunt) thereby preventing any undue firing.

The invention claimed is:

1. A pyroelectronic header (1) including an electronic circuit (2) for at least controlling the firing of the header by sending a current into an electrothermal bridge (4), the electronic circuit receiving orders from a firing line to produce commands, the header moreover including at least an electrical shunting means, wherein the electrical shunting means (7) is active and arranged parallel to the bridge (4), the electrical shunting means being controlled via commands between a first state and a second state, wherein when the electrical shunting means is in said first state the firing of the header is prevented by by-passing through the electrical shunting means the current of the bridge and when the electrical shunting means in said second state the electronic circuit controls firing of the header, wherein said first state is a first electric resistance closed state of the electrical shunting means and said second state is a second electric resistance open state of the electrical shunting means, the first electric resistance being less than the second electric resistance, and wherein the bridge, in a closed state, only sees a voltage ranging between zero volt and Rheader x Io header volts, Rheader being the resistance of the header and Io header the maximum non-firing intensity of the header.

2. The header according to claim 1, wherein the electrical shunting means when at rest is in a state corresponding to an impossible firing.

3. The header according to claim 1, wherein the electrical shunting means is bistable, the commands enabling to put the electrical shunting means either into a stable closed state or into a stable open state.

4. The header according to claim 1, wherein the electrical shunting means is monostable, the commands enabling to put the electrical shunting means either into a switchover state at least from an open state towards a closed state, wherein the switchover depends on a switchover threshold of bridge electrical signal, the switchover towards the closed state being obtained when the electrical signal applied to the bridge exceeds the threshold, either into a forced open state.

5. The header according to claim 4, wherein after switching over towards the closed state of the monostable electrical shunting means, said electrical shunting means switches again towards the open state when the electrical signal comes back under a threshold.

6. The header according to claim 4, wherein the threshold is a voltage threshold selected as being smaller than the product Rheader x Io header.

7. A header according to claim 6, wherein the resistance in closed state of the electrical shunting means is smaller than the resistance of the bridge divided by 10.

8. The header according to claim 1, wherein the electrical shunting means is a component selected from the group consisting of:

an electromagnetic relay,
a static relay,
a bipolar transistor,
a field effect transistor,
a thyristor,
a triac,
a micromechanical electrical switch (MEMS),
a diode,
a Zener diode, and
a neon.

9. The header according to claim 1, wherein the electrical shunting means is bidirectional.

10. The header according to claim 1, further comprising an ASIC-configurable electronic circuit, the electrical shunting means being inside or outside said circuit.

11. The header according to claim 1, further comprising means for enabling switchover to a state corresponding to a possible firing to be controlled by a desinhibition command sent into the header.

12. The header according to claim 1, further comprising means for enabling switchover to a state corresponding to an impossible firing to be controlled by an inhibition command sent into the header.

13. The header according to claim 1, wherein a control voltage for opening of the electrical shunting means is greater than the minimum operating voltage of the logic of the electronic module.

14. The header according to claim 2, wherein the electrical shunting means is bistable, the commands placing the electrical shunting means either into a stable closed state or a stable open state.

15. The header according to claim 3, wherein the threshold is a voltage threshold selected as being smaller than the product Rheader x Io header.

16. A pyroelectronic header (1) comprising:

an electronic circuit (2) that controls firing of the header by sending a current into an electrothermal bridge (4), the electronic circuit receiving orders from a firing line to produce commands; and an electrical shunt (7) that is active and arranged parallel to the bridge (4), the shunt being controllable via the commands that select a first electric resistance closed state of the shunt that prevents firing of the header while by-passing through the shunt the current of the bridge and a second electric resistance open state of the shunt, the first electric resistance being less than the second electric resistance, wherein the bridge, in a closed state, only sees a voltage ranging between zero volt and Rheader x Io header volts, Rheader being the resistance of the header and Io header the maximum non-firing intensity of the header.

* * * * *